US009530576B2

(12) United States Patent
Coleman et al.

(10) Patent No.: US 9,530,576 B2
(45) Date of Patent: Dec. 27, 2016

(54) DEVICE FOR REMOTE OPERATION OF ELECTRICAL DISCONNECT

(71) Applicant: Savannah River Nuclear Solutions, LLC, Aiken, SC (US)

(72) Inventors: Jody Rustyn Coleman, Aiken, SC (US); John Thomas Bobbitt, III, Evans, GA (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 223 days.

(21) Appl. No.: 14/249,468

(22) Filed: Apr. 10, 2014

(65) Prior Publication Data

US 2014/0305780 A1 Oct. 16, 2014

Related U.S. Application Data

(60) Provisional application No. 61/810,449, filed on Apr. 10, 2013.

(51) Int. Cl.

| | |
|---|---|
| ***H01H 3/20*** | (2006.01) |
| ***H01H 17/00*** | (2006.01) |
| ***H01H 3/02*** | (2006.01) |
| ***H01H 9/20*** | (2006.01) |
| ***H01H 71/10*** | (2006.01) |

(52) U.S. Cl.

CPC ..... *H01H 3/02* (2013.01); *H01H 9/20* (2013.01); *H01H 71/1018* (2013.01); *Y10T 29/49826* (2015.01)

(58) Field of Classification Search

CPC ..... H01H 3/02; H01H 9/20; H01H 71/1018

USPC ..... 200/330, 331

See application file for complete search history.

(56) References Cited

U.S. PATENT DOCUMENTS

| | | | | |
|---|---|---|---|---|
| 4,045,762 | A | 8/1977 | Foulkes | |
| 4,150,264 | A | 4/1979 | Lieberman | |
| 5,428,196 | A * | 6/1995 | Beatty, Jr. | H01H 3/36 200/329 |
| 6,479,780 | B2 | 11/2002 | Virtanen et al. | |
| 6,501,039 | B1 | 12/2002 | Mattlar et al. | |
| 6,706,984 | B1 * | 3/2004 | Turner | F16C 1/12 200/331 |
| 6,777,627 | B1 | 8/2004 | Stevenson | |
| 6,897,388 | B2 | 5/2005 | Greer | |
| 7,019,230 | B1 | 3/2006 | Vaill et al. | |
| 7,623,011 | B2 | 11/2009 | Rowe et al. | |

(Continued)

FOREIGN PATENT DOCUMENTS

JP 4664407 B2 4/2011

*Primary Examiner* — Renee Luebke
*Assistant Examiner* — Lheiren Mae A Caroc
(74) *Attorney, Agent, or Firm* — Dority & Manning, P.A.

(57) ABSTRACT

Provided is a device for remote operation of an electrical disconnect. The device can include a handle clamp configured to be secured to an extending member of the electrical disconnect. The device can further include a case clamp configured to be secured to a rigid portion of the electrical disconnect. The device can further include a cable having an exterior sheath coaxially surrounding an inner cable. The inner cable can be coaxially slidable with respect to the exterior sheath. The inner cable can extend through an opening of the case clamp and be secured to the handle clamp. The device can further include an actuator configured to coaxially slide the inner cable such that the handle clamp is actuated towards the case clamp.

21 Claims, 6 Drawing Sheets

(56) References Cited

U.S. PATENT DOCUMENTS

| | | | |
|---|---|---|---|
| 8,063,323 | B1 | 11/2011 | Ledbetter |
| 8,151,452 | B2 | 4/2012 | Ledbetter |
| 8,161,631 | B1 | 4/2012 | Ledbetter et al. |
| 8,228,225 | B1 | 7/2012 | Ledbetter et al. |
| 2005/0139461 | A1 | 6/2005 | McClung |
| 2009/0301851 | A1 | 12/2009 | Morris et al. |
| 2012/0024677 | A1 | 2/2012 | Safreed, III et al. |
| 2012/0067707 | A1 | 3/2012 | Pollitt et al. |

* cited by examiner

DEVICE FOR REMOTE OPERATION OF ELECTRICAL DISCONNECT

PRIORITY CLAIM

The present application claims the benefit of priority of U.S. Provisional Patent Application Ser. No. 61/810,449, titled Device for Remote Operation of Electrical Disconnect, filed Apr. 10, 2013, which is incorporated herein by reference for all purposes.

FEDERAL RESEARCH STATEMENT

This invention was made with Government support under Contract No. DE-AC09-08SR22470, awarded by the U.S. Department of Energy. The Government has certain rights in the invention.

FIELD

The present disclosure relates generally to a device for remote operation of an electrical disconnect. In particular, the present disclosure relates to a device that allows for the remote operation of arm-style electrical disconnect.

BACKGROUND

Electrical disconnects, also known as electrical disconnect switches, are commonly used in commercial and/or industrial sites in order to regulate the flow of electricity to certain areas or machines of the site. One type of electrical disconnect is an arm-style electrical disconnect, which features an arm or other extending member which can be actuated between a first position and a second position in order to respectively allow or disallow the flow of electricity.

Electrical disconnects can present a severe hazard to an operator that manually actuates the disconnect. In particular, an arc flash event can occur when the disconnect is actuated, causing bodily harm or death due to high temperatures or high voltage applied to the body.

One attempt to remedy this danger is to require that an operator wear personal protective equipment such as specialized arc flash clothing. However, different levels of potential arc flash events require various degrees of protective clothing and operators may not be fully informed as to which pieces of equipment correspond with each various potential danger. Further, operators must adorn and then remove the personal protective equipment at each instance in which the electrical disconnect is operated, an inconvenient necessity. Due to such inconvenience, operators may unfortunately seek shortcuts and operate the electrical disconnect without properly adorning all items of equipment, rendering themselves susceptible to injury.

Another attempted solution is to provide devices that allow for remote operation of the electrical disconnect. However, many of these devices include stored energy such as batteries, springs, or other items. Such stored energy can cause the device to inadvertently actuate, an inherently unsafe situation.

Remote devices that do not contain such stored energy may present other drawbacks. For example, a long reach pole requires clear access to the electrical disconnect, which may not always be available in a compact electrical room. Further, different levels of potential arc flash events can require different separation differences and devices that are not easily adjustable may not be able to satisfy this requirement.

Therefore, an improved device that allows remote operation of an electrical disconnect is desirable.

SUMMARY

Aspects and advantages of the invention will be set forth in part in the following description, or may be obvious from the description, or may be learned through practice of the invention.

One aspect of the present disclosure relates to a device for remote operation of an electrical disconnect. The device can include a handle clamp configured to be secured to an extending member of the electrical disconnect. The device can further include a case clamp configured to be secured to a rigid portion of the electrical disconnect. The device can further include a cable having an exterior sheath coaxially surrounding an inner cable. The inner cable can be coaxially slidable with respect to the exterior sheath. The inner cable can extend through an opening of the case clamp and be secured to the handle clamp. The device can further include an actuator configured to coaxially slide the inner cable such that the handle clamp is actuated towards the case clamp.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
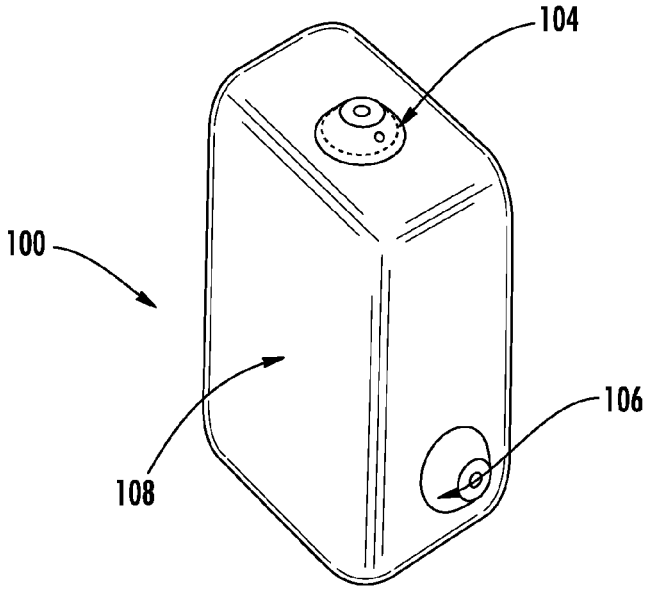
FIG. 1 depicts an exemplary handle clamp according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is generally directed to a device that allows for remote operation of an electrical disconnect switch in order to eliminate the danger posed by arc flash events. The device can include a handle clamp that is secured to an extending member of the electrical disconnect. For example, an arm-style electrical disconnect can feature an arm or other extending member which can be actuated between a first position and a second position in order to respectively allow or disallow the flow of electricity.

The handle clamp can be secured to such an extending member. For example, the handle clamp can include a thumbscrew that presses the extending member against a wall of the handle clamp such that the handle clamp is secured to the extending member. As another example, the handle clamp can include a squeeze type clamp. The squeeze type clamp can pull the extending member against a wall of the handle clamp such that the handle clamp is secured to the extending member.

The device can also include a case clamp. The case clamp can be secured to a rigid portion of the electrical disconnect. For example, the rigid portion of the electrical disconnect can be a lip of the electrical disconnect case cover. The case clamp can include a clamp plate, a flange clamp, and a reaction arm. The clamp plate and the flange clamp can be secured together around the lip of the case cover. The reaction arm can extend beyond the clamp plate and the flange clamp, as secured to the case cover. The reaction arm can be adjustable in extension length and extension direction. The reaction arm can include an opening.

The device can also include a cable having an exterior sheath that coaxially surrounds an inner cable. The inner cable can be coaxially slidable with respect to the exterior sheath. For example, the cable can be a Bowden cable. The inner cable can extend through the opening of the reaction arm and be secured to the handle clamp. For example, the handle clamp can include a passage through which the inner cable can extend. The inner cable can be secured in such passage by a thumbscrew.

The exterior sheath can have a diameter that is greater than a diameter of the opening of the reaction arm. The exterior sheath can abut a face of the reaction arm that is distal with respect to the handle clamp such that the inner cable freely extends through the opening of the reaction arm while the exterior sheath is restrained by the reaction arm.

The device can also include an actuator configured to coaxially slide the inner cable such that the handle clamp is actuated towards the case clamp. In one exemplary embodiment, the actuator can have a T-handle and a hand grip. The inner cable can freely extend through an opening of the hand grip and be secured or otherwise attached to the T-handle. The exterior sheath can abut a face of the hand grip that is distal with respect to the T-handle such that the exterior sheath is restrained by the hand grip. Therefore, pulling the T-handle away from the hand grip while the hand grip is held stationary can result in coaxially sliding the inner cable with respect to the exterior sheath. As a result, the handle clamp can be pulled towards the case clamp, actuating the electrical disconnect.

In another exemplary embodiment, the actuator can include a pistol grip and a trigger. The trigger can be configured such that when the trigger is pulled the inner cable is pulled or otherwise coaxially slid with respect to the exterior sheath. For example, the inner cable can be connected to a rod with a plurality of teeth or holds. The actuator can be configured such that each squeeze of the trigger causes the rod to be moved forward and held in place by the next tooth. In such fashion, the extending member of the electrical disconnect can be actuated over a number of trigger pulls. Therefore, an electrical disconnect that requires a longer cable pull, greater linear force, or both a longer cable pull and greater linear force can be accommodated. The actuator can also include a safety and a tension release button.

FIG. 1 depicts an exemplary handle clamp 100 according to an exemplary embodiment of the present disclosure. Handle clamp 100 can be rectangle-shaped as shown in FIG. 1. Alternatively, handle clamp 100 can be cylindrical or tube-shaped. Generally, however, handle clamp 100 can be any suitable shape or size such that it can be secured to a desired extending member, handle, or other actuable element of the electrical disconnect.

Handle clamp 100 can include a first screw guide 104 and a second screw guide 106. Screw guides 104 and 106 can include threaded holes or guides to accommodate thumbscrews of any suitable diameter or threading. In one implementation, as shown in FIG. 1, screw guides 104 and 106 can be partially formed by protrusions from the body of handle clamp 100.

Figure 2:
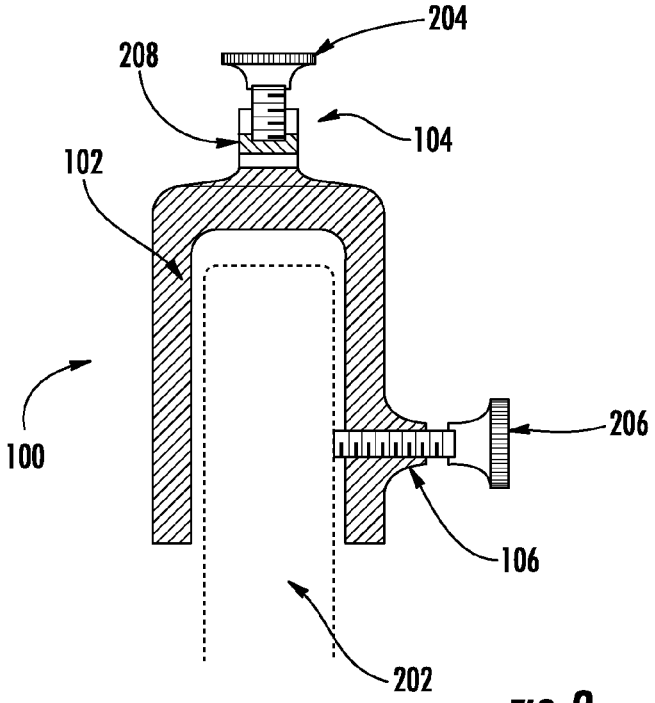
FIG. 2 depicts a cross-sectional view of an exemplary handle clamp according to an exemplary embodiment of the present disclosure.

FIG. 2 depicts a cross-sectional view of exemplary handle clamp 100 according to an exemplary embodiment of the present disclosure. As shown, handle clamp 100 can have a hollow interior and can be open on at least one end, such that handle 202 can reside within the interior of handle clamp 100. Handle 202 can be an extending member of an electrical disconnect. For example, actuation of handle 202 from a first position to a second position allows or disallows the flow of electricity. Lining the wall of handle clamp 100 can be a soft or flexible material, such as rubber or gel padding. As an example, a material lining the wall of handle clamp 100 can conform to the particular shape of handle 202. As another example, a material lining the wall of handle clamp 100 can increase friction between handle clamp 100 and handle 202.

Thumbscrew 204 can be screwed into screw guide 104. The scope of the present disclosure is not limited to the use of thumbscrews, but can include other suitable fasteners or securing mechanisms, such as traditional screws, bolts, pins, or other suitable securing means.

Further, screw guide 104 can include a passageway 208. Thumbscrew 204 can be screwed into screw guide 104 such that a cable extending through the passageway 208 is held into place or otherwise secured. Thus, when thumbscrew 204 secures a cable present in passageway 208, force applied to such cable is transferred to handle clamp 100.

Screw guide 104 can further optionally include a swivel mechanism such that the orientation of passageway 208 is rotatable about a plane perpendicular to the axis of thumbscrew 204. For example, such swivel mechanism can be achieved using a ball and socket in the portion of screw guide 104 below passageway 208 (not pictured). As another example, such swivel mechanism can be achieved by attaching screw guide 104 to the body of handle clamp 100 using an additional screw or other fastening means (not pictured).

Thumbscrew 206 can be screwed into screw guide 106. In particular, thumbscrew 206 can traverse screw guide 106 such that it penetrates into the interior of handle clamp 100. Thumbscrew 206 can apply pressure to handle 202 such that it is tightly pressed against a back wall 102 of handle clamp 100. In such fashion, handle clamp 100 can be secured to handle 202 such that force applied to handle clamp 100 is transferred to handle 202.

Thus, handle clamp 100 can be operated by placing handle clamp 100 over handle 202, tightening thumbscrew 206, adjusting the length of a cable traversing passageway 208, and tightening thumbscrew 204. Due to the adjustability of thumbscrew 206, handle clamp 100 can be adaptable to a wide range of handles. Further, due to the adjustability of the length of the cable traversing passageway 208, handle clamp 100 can be adaptable to a wide range of electrical disconnect box sizes. In addition, handle clamp 100 can be easily installed and removed. Further, as will be discussed later, the optional swivel mechanism can allow for a single installation of handle clamp 100 to perform actuation of the handle 202 in either direction (e.g. from the first position to the second position or from the second position to the first position).

Although FIGS. 1 and 2 depict screw guide 104 protruding from a top wall of handle clamp 100, one of ordinary skill in the art will appreciate that such placement is for the purposes of example only. As an example, screw guide 104 can alternatively be placed on either side wall of the handle clamp 100, including side wall 108.

Furthermore, although FIGS. 1 and 2 depict handle clamp 100 as being a separate and distinct component that is secured to the handle 202, it should be appreciated that, in some embodiments, handle clamp 100 can be integral to handle 202.

Figure 3:
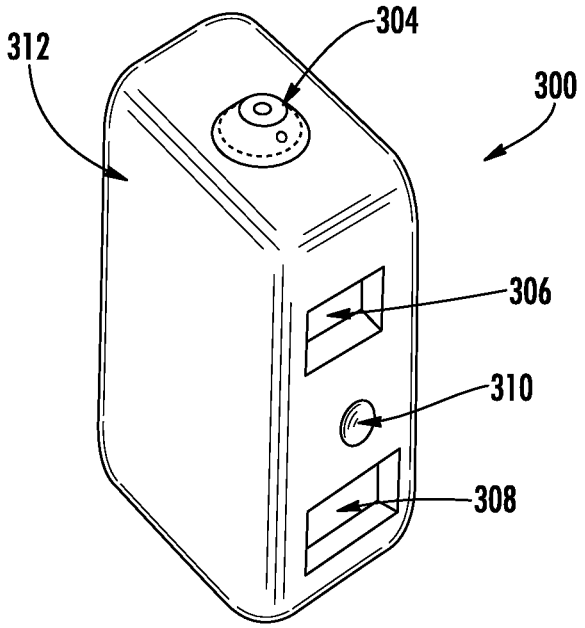
FIG. 3 depicts an exemplary handle clamp according to an exemplary embodiment of the present disclosure.

FIG. 3 depicts an exemplary handle clamp 300 according to an exemplary embodiment of the present disclosure. Handle clamp 300 can be rectangle-shaped as shown in FIG. 3. Alternatively, handle clamp 300 can be cylindrical or tube-shaped. Generally, however, handle clamp 300 can be any suitable shape or size such that it can be secured to a desired extending member of the electrical disconnect.

Handle clamp 300 can include a first screw guide 304. Screw guide 304 can include a threaded hole or guide to accommodate thumbscrews of any suitable diameter or threading. In one implementation, as shown in FIG. 3, screw guide 304 can be partially formed by a protrusion from the body of handle clamp 300.

Handle clamp 300 can further include openings 306 and 308. Openings 306 and 308 can open into the interior of handle clamp 300. Openings 306 and 308 can be rectangular or any other suitable shape. Handle clamp 300 can further include a socket 310. Socket 310 can be a depression in a front wall of handle clamp 300.

Figure 4:
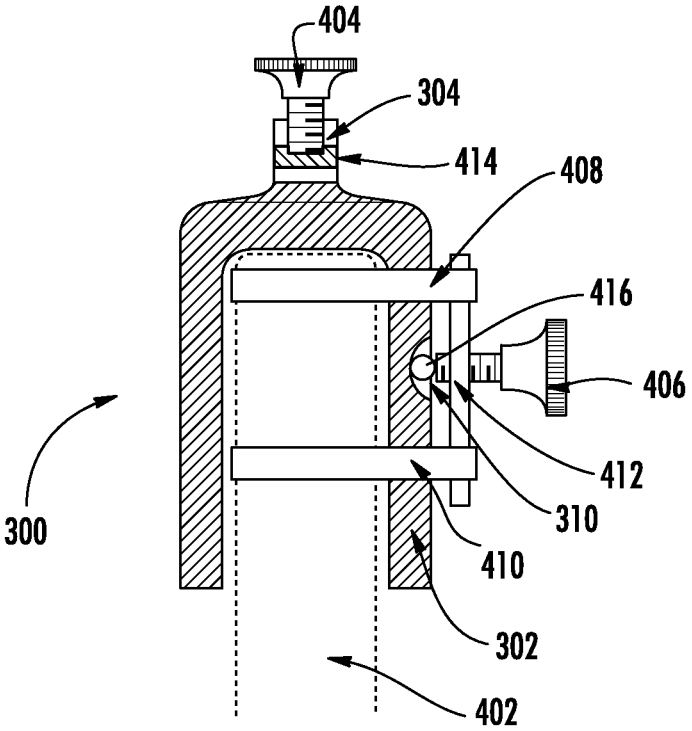
FIG. 4 depicts a cross-sectional view of an exemplary handle clamp according to an exemplary embodiment of the present disclosure.

FIG. 4 depicts a cross-sectional view of exemplary handle clamp 300 according to an exemplary embodiment of the present disclosure. As shown, handle clamp 300 can have a hollow interior and can be open on at least one end, such that handle 402 can reside within the interior of handle clamp 300. Handle 402 can be an extending member of an electrical disconnect such that actuation of handle 402 from a first position to a second position either allows or disallows the flow of electricity. Lining the wall of handle clamp 300 can be a soft or flexible material, such as rubber or gel padding. As an example, a material lining the wall of handle clamp 300 can conform to the particular shape of handle 402. As another example, a material lining the wall of handle clamp 300 can increase friction between handle clamp 300 and handle 402.

Thumbscrew 404 can be screwed into screw guide 304. The scope of the present disclosure is not limited to the use of thumbscrews, but can include other suitable fasteners or securing mechanisms, such as traditional screws, bolts, pins, or other suitable securing means.

Further, screw guide 304 can include a passageway 414. Thumbscrew 404 can be screwed into screw guide 304 such that a cable extending through the passageway 414 is held into place or otherwise secured. Thus, when thumbscrew 404 secures a cable present in passageway 414, force applied to such cable is transferred to handle clamp 300.

Screw guide 304 can further optionally include a swivel mechanism such that the orientation of passageway 414 is rotatable about a plane perpendicular to the axis of thumbscrew 404. For example, such swivel mechanism can be achieved using a ball and socket in the portion of screw guide 304 below passageway 414 (not pictured). As another example, such swivel mechanism can be achieved by attaching screw guide 304 to the body of handle clamp 300 using an additional screw or other securing means (not pictured).

Handle clamp 300 can further include a squeeze type clamp formed by a band clamp 412 and two loop clamps 408 and 410. Band clamp 412 and loop clamps 408 and 410 can be steel plates or other suitable materials, including non-metallic materials. In one implementation, loop clamps 408 and 410 are welded to band clamp 412. In another implementation, loop clamps 408 and 410 each have an opening through which band clamp 412 extends and are held in place through mechanical pressure applied by way of thumbscrew 406.

Loop clamps 408 and 410 can respectively extend through openings 306 and 308. Further, loop clamps 408 and 410 can each have an opening through which handle 402 is inserted such that loop clamps 408 and 410 can pull handle 402 towards a front wall 302 of handle clamp 300. Furthermore, although two loop clamps 408 and 410 are shown and discussed, it will be appreciated that other numbers of loop clamps can be used instead, including, for example, one loop clamp or more than two loop clamps.

Thumbscrew 406 can be screwed through a threaded hole present in band clamp 412. In particular, thumbscrew 406 can traverse band clamp 412 such that it presses against a ball 416 present in socket 310. Thumbscrew 406, by pressing against ball 416 and, thus, socket 310, can apply outward pressure to band clamp 412. Band clamp 412 can pull loop clamps 408 and 410. In turn, loop clamps 408 and 410 can pull handle 402 tightly against wall 302 of handle clamp 300. In such fashion, handle clamp 300 can be secured to handle 402 such that force applied to handle clamp 300 is transferred to handle 402. Further, the use of ball 416 and socket 310 allows the orientation of band clamp 412 to be adjusted based on the particular device requirements, such as the shape of handle 402

Thus, handle clamp 300 can be operated by placing handle clamp 300 over handle 402 such that loop clamps 408 and 410 surround handle 402 and tightening thumbscrew 406 to pull band clamp 412 and, therefore, loop clamps 408 and 410 outwardly, causing handle 402 to press against wall 302. The length of a cable traversing passageway 414 can be adjusted and thumbscrew 404 can be tightened.

Due to the adjustability of thumbscrew 406 and ball and socket 416 and 310, handle clamp 300 can be adaptable to a wide range of handles. Further, due to the adjustability of the length of the cable traversing passageway 414, handle clamp 300 can be adaptable to a wide range of electrical disconnect box sizes. In addition, handle clamp 300 can be easily installed and removed. Further, as will be discussed later, the optional swivel mechanism can allow for a single installation of handle clamp 300 to perform actuation of the handle 402 in either direction (e.g. from the first position to the second position or from the second position to the first position).

Although FIGS. 3 and 4 depict screw guide 304 protruding from a top wall of handle clamp 300, one of ordinary skill in the art will appreciate that such placement is for the purposes of example only. As an example, screw guide 304 can alternatively be placed on either side wall of the handle clamp 300, including side wall 312.

Furthermore, although FIGS. 3 and 4 depict handle clamp 300 as being a separate and distinct component that is secured to the handle 402, it should be appreciated that, in some embodiments, handle clamp 300 can be integral to the handle 402.

Figure 5:
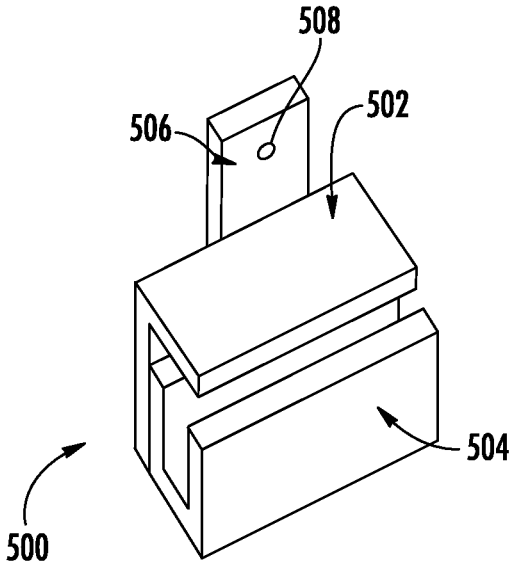
FIG. 5 depicts an exemplary case clamp according to an exemplary embodiment of the present disclosure.

FIG. 5 depicts an exemplary case clamp 500 according to an exemplary embodiment of the present disclosure. In particular, case clamp 500 can include a clamp plate 502, a flange clamp 504, and a reaction arm 506. Reaction arm 506 can have an opening 508. Clamp plate 502 and flange clamp 504 can be steel plates or other suitable materials. As shown in FIG. 5, Clamp plate 502 can have an elongated L-shape. As shown in FIG. 5, flange clamp 504 can have an elongated U-shape.

Together, clamp plate 502 and flange clamp 504 can secure to a rigid portion of the electrical disconnect. As an example, clamp plate 502 and flange clamp 504 can secure to a lip of a cover of the electrical disconnect. For example, the lip of the cover can be pressed between clamp plate 502 and flange clamp 504 and further extend downward into the space between the parallel walls of flange clamp 504.

Clamp plate 502 and flange clamp 504 can have a non-slip coating. For example, clamp plate 502 and flange clamp 504 can have a rubber coating or can be co-injection molded with a non-slip material. Further, clamp plate 502 and/or flange clamp 504 can include one or more integral magnets that assist in securing case clamp 500 to the electrical disconnect.

Figure 6:
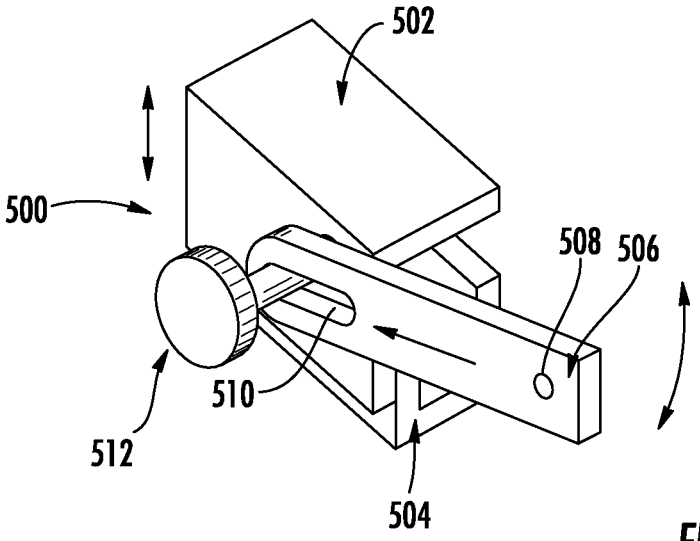
FIG. 6 depicts an exemplary case clamp according to an exemplary embodiment of the present disclosure.

FIG. 6 depicts exemplary case clamp 500 according to an exemplary embodiment of the present disclosure. In particular, FIG. 6 shows a rear view of case clamp 500.

As shown in FIG. 6, reaction arm 506, case clamp 502, and flange clamp 504 can be secured together using a thumbscrew 512. However, one of ordinary skill in the art will appreciate that the scope of the present disclosure is not limited to the use of thumbscrew 512 to secure reaction arm 506, case clamp 502, and flange clamp 504. Instead, any suitable securing means can be used, including, without limitation, bolts, traditional screws, or pins.

Reaction arm 506 can have an adjustable extension length and an adjustable extension direction. For example, a screw guide 510 of reaction arm 506 can be elongated such that the extension length of reaction arm 506 can be adjusted. In addition, reaction arm 506 can be rotated about a plane perpendicular to the axis of thumbscrew 512 prior to the tightening of thumbscrew 512 such that the extension direction of reaction arm 506 can be adjusted. In such fashion, reaction arm 506 can both pivot and slide about thumbscrew 512 when not tightly secured.

In one implementation, thumbscrew 512 can traverse reaction arm 506, clamp plate 502, and at least one wall of flange clamp 504 such that it penetrates into the interior portion of flange clamp 504 (i.e. the space between the parallel walls of flange clamp 504). In such fashion, thumbscrew 512 can be tightened until it applies pressure to a lip of the electrical disconnect cover, or other portion of the electrical disconnect that is pressed between clamp plate 502 and flange clamp 504 and present in the space between the parallel walls of flange clamp 504. In another implementation, a stud (not pictured) is connected to the interior face of the parallel wall of flange clamp 504 that is proximate to clamp plate 502. Such stud can receive thumbscrew 512.

Although not pictured in FIGS. 5 and 6, clamp plate 502 can also have an elongated screw guide such that its position with respect to flange clamp 504 can be adjusted prior to tightening thumbscrew 512. In such fashion, case clamp 500 can be adjusted to meet the specific dimensions of the lip of the electrical disconnect cover.

Reaction arm 506 can be used to support a cable. In particular, the device of the present disclosure can include a cable having an exterior sheath coaxially surrounding an inner cable. The inner cable can be coaxially slidable with respect to the exterior sheath. The inner cable can freely pass through opening 508 of reaction arm 506 while the exterior sheath can abut the outer face of reaction arm 506. The diameter of the exterior sheath can be greater than the diameter of opening 508. In one implementation, the exterior sheath can be secured to reaction arm 506 using a spring-closed flap or other suitable securing mechanism.

Furthermore, although FIGS. 5 and 6 discuss case clamp 500 as being a separate and distinct component that is secured to, for example, a lip of an electrical disconnect cover, it should be appreciated that, in some embodiments, case clamp 500 can be integral to the electrical disconnect case.

Figure 7:
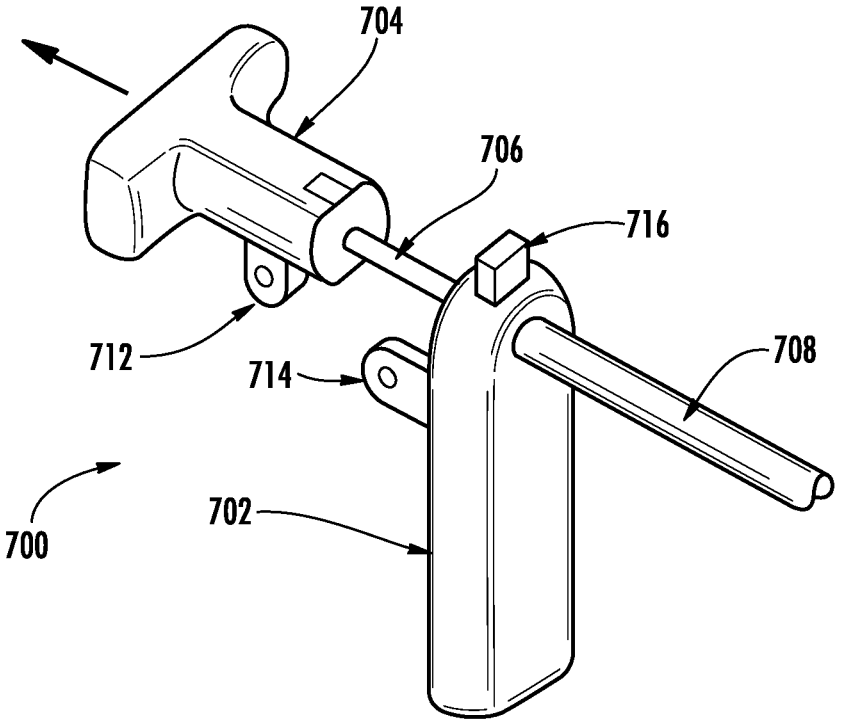
FIG. 7 depicts an exemplary actuator according to an exemplary embodiment of the present disclosure.

FIG. 7 depicts an exemplary actuator 700 according to an exemplary embodiment of the present disclosure. Actuator 700 can include a hand grip 702 and a T-handle 704. Hand grip 702 can have an opening or passageway through which an inner cable 706 can freely pass Inner cable 706 can be coaxially surrounded by outer sheath 708. Outer sheath 708 can have a diameter that is greater than the size of the opening in hand grip 702. Thus, outer sheath 708 can abut and/or be restrained by a face of hand grip 702 that is distal with respect to T-handle 704.

Together, inner cable 706 and outer sheath 708 can form a cable for use with the present device. For example, inner cable 706 and outer sheath 708 can be components of a Bowden cable. Inner cable 706 and outer sheath 708 can be flexible. Outer sheath 708 can be tubular and coaxially surround inner cable 706. For example, outer sheath 708 can have an inner diameter that is equivalent or only slightly larger than the diameter of inner cable 706. Outer sheath 708 can be made of rubber or any other suitable materials such as plastics.

Inner cable 706 can be coaxially slidable with respect to outer sheath 708. For example, inner cable 706 can be used in a push/pull mode, or a pull mode only. When configured for push/pull mode, inner cable 706 can transmit force in either axial direction. When inner cable 706 is configured for pull mode, inner cable 706 can only transmit force in a pulling fashion. The present disclosure can be implemented using either a push/pull cable or a pull only cable. However, because use of a pull only cable renders it less possible to inadvertently actuate the electrical disconnect in an undesired direction, a pull only cable is inherently safer and therefore preferred.

Inner cable 706 and outer sheath 708 can be made of non-conductive elements in order to prevent the cable from acting as an electrical ground path in the event of an arc flash event. As an example, inner cable 706 can be made of aramid fibers and outer sheath 708 can be made of plastic tubing. Use of an inner cable 706 made of aramid like materials provides the benefit of being flexible in a bending mode, but very stiff in the axial direction. The flexible bending mode allows for the cable to be routed around equipment or other obstructions if required, while the axial stiffness allows for greater operator feel for when the extending member of the electrical disconnect has been actuated to the desired location. As such, the cable generally does not need to have a linear path from the actuator to the electrical disconnect.

Thus, the use of a cable length greater than a zone of danger associated with potential arc flash events can eliminate the need for personal protective equipment. In particular, the cable length can be sized such that the operator only has to step back to the full length of the cable to ensure adequate distance from the electrical disconnect in order to be protected from any potential arc flash event. Therefore, different cable lengths can be made and used in order to provide the appropriate level of protection from different arc flash hazard levels. In fact, such different cable lengths can be used as a built-in gauge to ensure correct operator distancing from potential danger zones.

As discussed with reference to FIG. 6, at one end portion of the cable, outer sheath 708 interfaces with reaction arm 506 of case clamp 500 while inner cable 706 passes through opening 508 and then attaches to the handle clamp. Returning to FIG. 7, at the other end portion of the cable, outer sheath 708 interfaces with hand grip 702 of actuator 700 while inner cable pass through hand grip 702 and connects with T-handle 704 in some fashion.

While FIG. 7 specifically depicts a T-handle 704, the present disclosure is not limited to such specific shape. In particular, any suitable handle or gripping means can be used in place of T-handle 704, including, for example, a circular cap or spherical handle. Further, inner cable 706 can be attached to T-handle 704 using any suitable means. For example, a rod can extend from T-handle 704 and inner cable 706 can be secured to such rod. Hand grip 702 can be made of any suitable material and take any suitable form, including an ergonomic design such as the negative form of a clenched hand.

Actuator 700 can further include a lockout/tagout feature. For example, T-handle 704 can have a first lockout element 712 and hand grip 702 can have a second lockout element 714. A padlock, pin, or other appropriate means can be used to lockout/tagout actuator 700. In particular, a padlock can pass through the opening of first lockout element 712 and second lockout element 714 such that the two lockout elements are held at the same position. In such fashion, T-handle 704 cannot be moved away from hand grip 702 in order to actuate inner cable 706 without proper removal of such padlock.

Actuator 700 can further include an integral safety switch 716. Safety switch 716 can engage, hold, or otherwise secure inner cable 706 when not depressed or activated by the operator. Thus, in order to pull T-handle 704 away from hand grip 702 and actuate inner cable 706, an operator can be required depress safety switch 716 in addition to applying force to pull T-handle 704. In such fashion, inadvertent actuation can be avoided and inherent safety can be increased.

Figure 8:
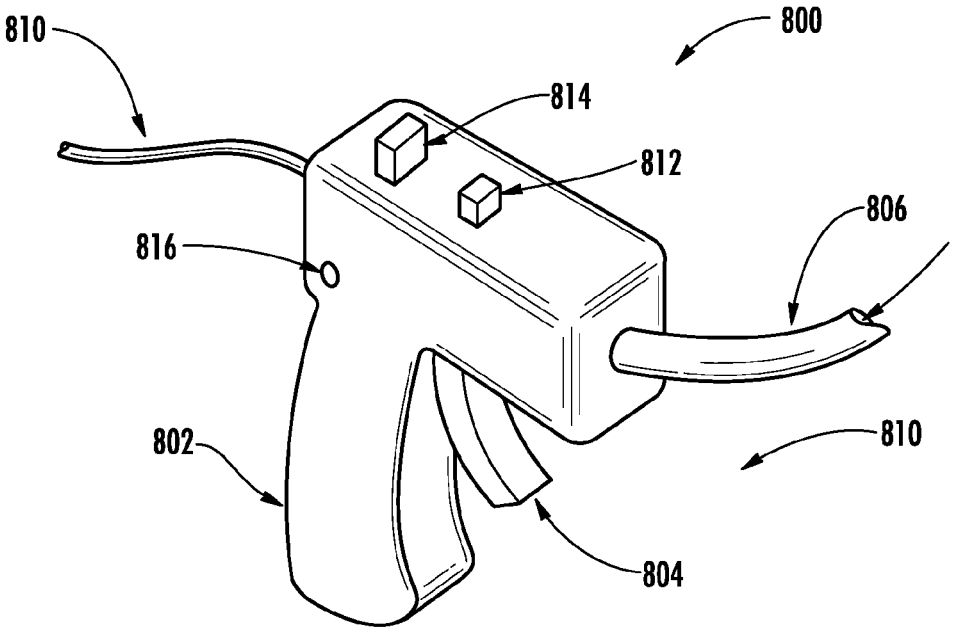
FIG. 8 depicts an exemplary actuator according to an exemplary embodiment of the present disclosure.

FIG. 8 depicts an exemplary actuator 800 according to an exemplary embodiment of the present disclosure. Actuator 800 can include a pistol grip 802 and a trigger 804. In particular, squeezing or otherwise operating trigger 804 can cause the actuation of an inner cable 810 with respect to an outer sheath 806. As an example, actuator 800 can be a pistol grip quick action clamp, such that operation of trigger 804 results in a cam action that causes inner cable 810 to be pulled forward. Outer sheath 806 can abut or otherwise be restrained by the front of actuator 800.

Although FIG. 8 depicts inner cable 810 as spanning the length of actuator 800, such depiction is for the purposes of example only. In particular, inner cable 810 can be connected or otherwise secured to a rod and actuator 800 can operate to actuate the rod instead of directly actuating inner cable 810 itself. As an example, such rod can have a plurality of teeth or holds. Such rod can be swaged to the end of inner cable 810. Actuator 800 can be configured such that each squeeze of trigger 804 causes the rod to be moved forward and held in place by the next tooth. In such fashion, inner cable 810 can be actuated with respect to outer sheath 806 over a number of pulls of trigger 804 and also over a significant distance. Further, cable pulls requiring greater linear force can be accommodated.

Actuator 800 can further include an integral safety switch 812. Safety switch 812 can engage, hold, or otherwise secure inner cable 810 or an associated rod when not depressed or activated by the operator. Thus, in order for trigger 804 to freely actuate inner cable 810 or an associated rod, an operator can be required depress safety switch 812 in addition to applying force to operate trigger 804. In such fashion, inadvertent actuation can be avoided and inherent safety can be increased.

Actuator 800 can further include a release 814. Release 814 can disconnect tension from actuator 800 with respect to inner cable 810, allowing inner cable 810 to be adjusted or slacked. As an example, release 814 can disconnect a pawl or catch from a toothed-rod connected to inner cable 810, thus allowing the rod to be freely retracted or adjusted in either direction.

Preferably, release 814 is capable of being toggled between at least a connected position and a disconnected position without requiring constant operator force. In such fashion, inner cable 810 can be adjusted with respect to the electrical disconnect at an opposite end of inner cable 810 without requiring an operator to constantly apply force at actuator 800.

Actuator 800 can further include a lockout/tagout feature 816. As an example, lockout feature 816 can be a passageway through actuator 800. Placing a padlock, pin, or other locking member or mechanism through lockout feature 816 can prevent operation of actuator 800. For example, one or more mechanical components of actuator 800 can be immobilized when a padlock is placed through lockout feature 816 such that operation of trigger 804 is prevented. In such fashion, inner cable 810 cannot be actuated without proper removal of such padlock.

Figure 9:
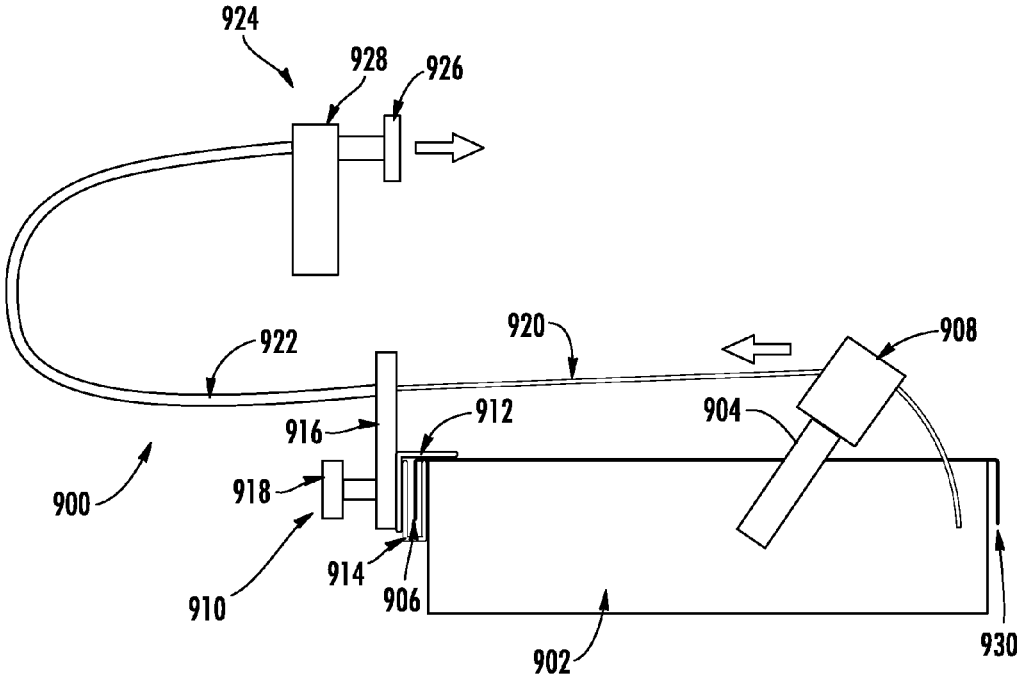
FIG. 9 depicts an exemplary device for remote operation of an electrical disconnect according to an exemplary embodiment of the present disclosure.

FIG. 9 depicts an exemplary device 900 for remote operation of an electrical disconnect 902 according to an exemplary embodiment of the present disclosure. In particular, device 900 can be operated in order to remotely actuate an extending member 904 of electrical disconnect 902. Device 900 can include a handle clamp 908, a case clamp 910, a cable that includes an inner cable 920 coaxially surrounded by an outer sheath 922, and an actuator 924.

Extending member 904 of electrical disconnect 902 can be a handle. Actuation of extending member 904 from a first position to a second position can allow or disallow the flow of electricity. Handle clamp 908 can be secured to extending member 904. Further, inner cable 920 can be secured in some fashion to handle clamp 908. In particular, at the time of installation, the free length or slack of inner cable 920 can be adjusted by loosening a top thumbscrew on handle clamp 908, passing inner cable 920 through a passageway of handle clamp 908, and tightening the top thumbscrew to secure inner cable 920 to handle clamp 904.

Case clamp 910 can be secured to a rigid portion of electrical disconnect 902. As an example, case clamp 910 can be secured to a lip 906 of the cover of electrical disconnect 902. Case clamp 910 can include a clamp plate 912, a flange clamp 914, and a reaction arm 916. Clamp plate 912 and flange clamp 914 can secure case clamp 910 to lip 906. A thumbscrew 918 can be used to secure clamp plate 912, flange clamp 914, and reaction arm 916 together. In one implementation, thumbscrew 918 traverses each of clamp plate 912, flange clamp 914, and reaction arm 916 and applies pressure to lip 906.

Inner cable 920 can freely pass through an opening in reaction arm 916. Outer sheath 922 can abut or be restrained by a face of reaction arm 916 that is distal with respect to handle clamp 908. The extending length and extending direction of reaction arm 916 can be adjusted such that a line of sight from the opening of reaction arm 916 to handle clamp 908 can be generally straight or linear.

Actuator 924 can include a handle 926 and a hand grip 928. Inner cable 920 can pass through an opening in hand grip 928 and be attached or otherwise secured to handle 926. Outer sheath 922 can abut or be restrained by a face of hand grip 928 that is distal with respect to handle 926.

Pulling handle 926 can cause inner cable 920 to coaxially slide with respect to outer sheath 922. Because outer sheath 922 is restrained by reaction arm 916, which is affixed with respect to lip 906 of electrical disconnect 902, the axial force of the inner cable will pull handle clamp 908 towards case clamp 910 and cause extending member 904 to actuate from a first position to a second position.

In particular, in one implementation, electrical disconnect 902 can include a spring or other biasing means to bias extending member 904 to either or both of the first position or the second position. Therefore, once extending member 904 has moved approximately fifty to sixty percent of its travel, such biasing means will forcefully throw extending member 904 into the second position. Such abrupt change in resistance to the pull of the cable can be felt by the operator. For electrical disconnects where the extending member is not spring loaded or biased, the cable will pull the extending member to the extent of possible travel, at which point the operator will feel an increase in resistance. In either fashion (i.e. abrupt decrease or increase in resistance), the change in force provides for tactile feedback to the operator that the electrical disconnect did, in fact, change state as desired. Such state can then be visually confirmed.

If reactivation of electrical disconnect 902 is desired, then case clamp 910 can be unsecured from lip 906 and, instead, secured to lip 930 in an analogous fashion. In implementations where handle clamp 908 includes a rotatable screw guide or other swivel mechanism, handle clamp 908 does not need to be disconnected from extending member 904. Instead, the orientation of inner cable 920 with respect to the body of handle clamp 908 can simply be swiveled one hundred and eighty degrees.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A device for the remote operation of an electrical disconnect, the device comprising:

a handle clamp configured to be secured to an extending member of the electrical disconnect;

a case clamp configured to be secured to a rigid portion of the electrical disconnect;

a cable having an exterior sheath coaxially surrounding an inner cable, wherein the inner cable is coaxially slidable with respect to the exterior sheath, and wherein the inner cable extends through an opening of the case clamp and is secured to the handle clamp; and an actuator configured to coaxially slide the inner cable such that the handle clamp is actuated towards the case clamp;

wherein the handle clamp defines a passage through which the inner cable extends; and wherein the inner cable is secured in the passage by a fastener.

2. The device of claim 1, wherein the extending member of the electrical disconnect comprises an arm of the electrical disconnect.

3. The device of claim 1, wherein the handle clamp comprises one of a fastener that presses the extending member against a wall of the handle clamp or a squeeze type clamp that pulls the extending member against a wall of the handle clamp.

4. The device of claim 1, wherein the rigid portion of the electrical disconnect comprises a lip of a case cover of the electrical disconnect.

5. The device of claim 1, wherein the case clamp comprises:

a clamp plate;

a flange clamp; and a reaction arm, wherein the reaction arm defines the opening through which the inner cable extends.

6. The device of claim 5, wherein:

the clamp plate and the flange clamp are secured together around a lip of a case cover of the electrical disconnect; and the reaction arm extends beyond the clamp plate and the flange clamp when the clamp plate and the flange clamp are secured together around the lip of the case cover of the electrical disconnect.

7. The device of claim 5, wherein the reaction arm has one or more of an adjustable extension length and an adjustable extension direction.

8. The device of claim 5, wherein the exterior sheath has a first diameter that is greater than a second diameter of the opening of the reaction arm.

9. The device of claim 8, wherein the exterior sheath abuts a first face of the reaction arm, wherein the first face is distal with respect to the handle clamp such that the inner cable freely extends through the opening of the reaction arm while the exterior sheath is restrained by the reaction arm.

10. The device of claim 1, wherein the actuator comprises:

a T-handle; and a hand grip;

wherein the inner cable freely extends through an opening of the hand grip and is secured to the T-handle; and wherein the exterior sheath abuts a face of the hand grip that is distal with respect to the T-handle such that the exterior sheath is restrained by the hand grip, whereby an operator can force the T-handle away from the hand grip to cause the inner cable to coaxially slide with respect to the exterior sheath.

11. The device of claim 1, wherein the actuator comprises:
a pistol grip; and
a trigger configured such that when the trigger is operated the inner cable is coaxially slid with respect to the outer sheath.

12. The device of claim 11, wherein:
the trigger is connected to a rod;
the inner cable is secured to the rod;
the exterior sheath is restrained by the pistol grip; and
operation of the trigger causes the rod to be advanced and held in place by one of a plurality of teeth.

13. The device of claim 1, wherein one or more of the handle clamp and the case clamp is integral to the electrical disconnect.

14. The device o claim 1, wherein both the exterior sheath and the inner cable are non-conductive.

15. The device of claim 1, wherein the inner cable transmits force only in a pulling direction whereby the actuator is operable to coaxially slide the inner cable such that the handle clamp is actuated towards the case clamp but is not operable to coaxially slide the inner cable such that the handle clamp is actuated away from the case clamp.

16. The device of claim 1, wherein the case clamp is configured to be removably secured to a lip of the electrical disconnect.

17. A method for remotely operating an electrical disconnect, the method comprising:
securing a handle clamp to an extending member of the electrical disconnect, wherein the extending member can be actuated between a first position and a second position in order to respectively allow or disallow the flow of electricity;
securing a case clamp to a rigid portion of the electrical disconnect;
passing an inner cable through an opening defined by the case clamp, wherein the inner cable is coaxially slidable with respect to an exterior cable sheath, wherein passing the inner cable through the opening defined by the case clamp comprises passing the inner cable through the opening defined by the case clamp such that the exterior sheath abuts a first face of a reaction arm of the case clamp and the inner cable freely extends through the opening of the reaction arm while the exterior sheath is restrained by the reaction arm, and wherein the first face is distal with respect to the handle clamp;
securing the inner cable to the handle clamp; and
operating an actuator to coaxially slide an inner cable with respect to exterior sheath such that the handle clamp is actuated towards the case clamp, whereby the extending member of the electrical disconnect is actuated from the first position to the second position.

18. The method of claim 17, wherein:
the actuator comprises:
a T-handle; and
a hand grip, the hand grip defining a second opening; and
the method further comprises:
passing the inner cable through the second opening such that the exterior sheath abuts a face of the hand grip that is distal with respect to the T-handle and the exterior sheath is restrained by the hand grip; and
securing the inner cable to the T-handle;
wherein operating the actuator comprises forcing the T-handle away from the hand grip to cause the inner cable to coaxially slide with respect to the exterior sheath.

19. A system for the remote operation of an arm-style electrical disconnect, the system comprising:
a handle clamp configured to be placed over an arm of the electrical disconnect and secured to the arm;
a case clamp configured to be clamped to a lip of a case cover of the electrical disconnect, wherein the case clamp comprises a clamp plate having an elongated L-shape and a flange clamp having an elongated U-shape, and wherein the case clamp is configured to be clamped to the lip of the case cover by pressing the lip of the case cover between the clamp plate and the flange clamp;
a cable having an exterior sheath coaxially surrounding an inner cable, wherein the inner cable is coaxially slidable with respect to the exterior sheath, and wherein the inner cable extends through an opening of the case clamp and is secured to the handle clamp; and
an actuator configured to coaxially slide the inner cable such that the handle clamp is actuated towards the case clamp.

20. The system of claim 19, wherein:
the handle clamp comprises a screw guide defining a passageway through which the inner cable extends and is secured by a fastener; and
the screw guide comprises a swivel mechanism such that the orientation of the passageway is rotatable about a plane perpendicular to an axis of the fastener.

21. The system of claim 19, wherein the handle clamp comprises:
a band clamp; and
a first loop clamp and a second loop clamp that respectively extend through two openings defined by a body of the handle clamp and respectively surround the arm;
wherein a thumbscrew is screwed through the band clamp and presses against a ball present in a socket defined by the body of the handle clamp; and
wherein tightening the thumbscrew applies outward pressure to the band clamp thereby pulling the loop clamps and the arm against an interior wall of the body of the handle clamp.

* * * * *